US005437326A

United States Patent [19]

Graham et al.

[11] Patent Number: 5,437,326

[45] **Date of Patent: * Aug. 1, 1995**

[54] METHOD AND APPARATUS FOR CONTINUOUS CASTING OF METAL

[75] Inventors: Thomas S. Graham, Shelburne; Wojtek Szczypiorski; Jerome B. Allyn, both of Colchester; Dean A. Boozan, Waterville; George Desorcie, Westford; Norman Bergeron, Burlington; R. William Hazelett, Colchester; John Pennucci, Grand Isle; S. Richard Hazelett, Colchester, all of Vt.

[73] Assignee: Hazelett Strip-Casting Corporation, Colchester, Vt.

[ * ] Notice: The portion of the term of this patent subsequent to Jan. 18, 2011 has been disclaimed.

[21] Appl. No.: 84,352

[22] Filed: Jun. 28, 1993

Related U.S. Application Data

[63] Continuation-in-part of Ser. No. 931,824, Aug. 18, 1992, Pat. No. 5,279,352.

[51] Int. Cl.[6] ..... B22D 11/06

[52] U.S. Cl. ..... 164/481; 164/72; 164/432

[58] Field of Search ..... 164/481, 431, 432, 477, 164/72, 138; 427/460, 475, 482; 118/627, 630, 621

[56] References Cited

U.S. PATENT DOCUMENTS

| | | | |
|---|---|---|---|
| 3,000,752 | 9/1961 | Jackson et al. | 427/460 |
| 3,163,896 | 1/1965 | Rochester et al. | 164/481 |
| 3,536,580 | 10/1970 | La Fave | 118/621 |
| 3,795,269 | 3/1974 | Leconte et al. | 164/73 |
| 3,937,270 | 2/1976 | Hazelett et al. | 164/50 |
| 4,354,451 | 10/1982 | Vöhringer et al. | 118/326 |
| 4,425,411 | 1/1984 | Textor et al. | 428/702 |
| 4,487,157 | 12/1984 | Bergeron et al. | 118/59 |
| 4,487,790 | 12/1984 | Bergeron et al. | 164/446 |
| 4,537,243 | 8/1985 | Hazelett et al. | 164/481 |
| 4,545,423 | 10/1985 | Platek et al. | 164/481 |
| 4,588,021 | 5/1986 | Bergeron et al. | 164/432 |
| 4,749,027 | 6/1988 | Allyn et al. | 164/481 |
| 4,901,785 | 2/1990 | Dykes et al. | 164/481 |
| 4,921,037 | 5/1990 | Bergeron et al. | 164/432 |
| 5,033,532 | 7/1991 | Aoyama | 164/138 |

FOREIGN PATENT DOCUMENTS

| | | | |
|---|---|---|---|
| 791201 | 7/1968 | Canada . | |
| 1249250 | 4/1989 | Japan | 164/481 |

OTHER PUBLICATIONS

Miller, Glenn H., "Corona discharge", 1977 edition of *McGraw-Hill Encyclopedia of Science and Technology*, pp. 542–543.

Hughes, J. F., *Electrostatic Powder Coating*, 1984, pp. 1–28, Letchworth, Hertfordshire, England.

Boylett, F. D. A. and Looms, J. S. T., "Effect of discharge products upon corona discharge and spark breakdown voltage", 1963 *IEEE—Proceedings*, pp. 1–5, Great Britain.

*Primary Examiner*—Mark Rosenbaum
*Assistant Examiner*—James Miner
*Attorney, Agent, or Firm*—Parmelee, Bollinger & Bramblett

[57] ABSTRACT

Electrostatic application of a dusting of dry, electrostatically adherable, thermally insulative powder particles over a workface of a continuous metal-casting machine in which the mold surface or surfaces which provide the workface or workfaces revolve in a generally oval course. A dry dusting of protective powdery refractory material is applied to the workface after being entrained in an air stream and electrostatically charged by suitable electrostatic apparatus. The workface to be dusted is electrically grounded for attracting the charged powder particles for adhering them to the workface. The resultant coating formed by the dusting so deposited is remarkably uniform over a substantial area of the workface, a phenomenon explainable by mutual electrostatic repulsion of the dry powder particles being deposited. Continuously re-applied dusting over the workface during a continuous cast provides an immediately useful repair or replacement of dusting powder lost from the coating on the workface of a revolving mold surface during casting. The dusting may be removed at will by means of an air knife.

33 Claims, 8 Drawing Sheets

METHOD AND APPARATUS FOR CONTINUOUS CASTING OF METAL

RELATED APPLICATION

The present patent application is a Continuation-in-Part of prior application Ser. No. 07/931,824, filed on Aug. 18, 1992, and issued Jan. 18, 1994 as U.S. Pat. No. 5,279,352.

FIELD OF THE INVENTION

The present invention is for the improvement of processes, machines and apparatus for the continuous casting of molten metal in which the mold surface or surfaces revolve continuously in a generally oval course. More particularly, this invention relates to methods and apparatus for electrostatic application of insulative dust or powder to mold surfaces of such machines.

BACKGROUND OF THE INVENTION

Insulative, non-wetting mold coverings have been, and continue to be, part of the strategy to eliminate the problem of uneven heat transfer and its attendant bad effect on the metallurgy of the cast product of moving-mold continuous casting machines. These non-wetting coverings include permanent pre-coverings or base coverings (hereinafter called "basings"). These are described in U.S. Pat. No. 4,588,021 of Bergeron et al. Also, there are the more or less temporary top deposits or top dressings or temporary insulative deposits or toppings or mold-release agents, which are applied on top of a basing. All prior-art top or temporary insulative deposits known to us wear and compact and flatten unevenly and thus soon require replenishment or replacement. Manual replenishment of the unevenly worn or flattened spots does not in practice result in re-establishing a top deposit that affords uniform heat transfer. Nor has it been feasible to strip and reapply the prior-art insulative toppings, which usually comprise a binder.

Most of the prior-art top deposits were applied wet. Thus, residues of liquid resulting from such wet applications would sometimes flash into gas and cause porosity or other problems in the cast product. In the casting of copper bar or copper anodes in belt-type machines, synthetic oils upon otherwise bare metallic casting belts have been customary, sometimes resulting in similar porosity problems. None of the prior art known to us can achieve the unique results disclosed herein.

There is a prior-art method for continuous casting of metal in a belt-type machine, the method comprising an operation of feeding molten metal into a mold region defined by two flexible, continuously moving, water-cooled casting belts having workfaces (U.S. Pat. No. 3,795,269, 164/73, of Leconte et al., issued 5 Mar. 1974). A two-layer dressing is applied to each casting surface. The first layer is a basing dressing which includes a heat-insulating coating fixedly adhered to the workface of the casting belt. The second layer is a removable parting layer of dry powder particles, deposited over said basing layer. As elements of the casting surface move successively out of and into engagement with the metal being cast during each cycle of operation, the casting surface is cleaned to remove the previously applied parting layer of powder particles, and a fresh parting layer of powder particles is newly applied. There are two assemblies for applying a temporary insulative coating respectively to two casting belts.

Each assembly for applying the parting layer of powder particles is made as a hopper from which a layer of dry powder particles is scattered out, continuously covering the casting belt. This temporary parting layer is later removed by means of rotating steel brushes (U.S. Pat. No. 3,795,269).

Our opinion as to the patent of Leconte et al. is that it does not describe the invention in terms that would enable one to carry it out. Specifically, insulative parting-layer powders must be applied in very thin coatings, lest the metallic product cast against them be contaminated or the product surfaces damaged. Moreover, the required thin coatings of powder must be applied in a quite uniform thickness, lest the rate of heat transfer in the freezing process become nonuniform in different areas of the casting belts, a condition that results in bad metallurgical properties in the cast product. Leconte et al. have not specified how they will apply such thin, uniform powder coatings. They mention only "a hopper distribution system" (column 5, lines 37–40). Anyone who has handled talc or other powder particles in bulk knows that this Indefinite disclosure will not suffice as a description of what must be done to achieve a suitable thin, uniform coating. The teaching of Leconte et al. as disclosed is imperfect. Further art is required to apply the powder in a suitable thin, uniform coating required in the art of continuous casting of metals upon moving cooling surfaces, especially upon flexible casting belts.

The task thus set for the present invention is to provide the method and the apparatus for increasing the service life of a mold surface while at the same time increasing the uniformity of heat transfer during successive contacts between the workface of a mold surface and the molten metal being continuously cast.

SUMMARY OF THE DISCLOSURE

The problems of an easily applied and maintained top insulative deposits for mold walls or workfaces of moving-mold continuous casting machines is solved or substantially overcome by the present invention. According to the method being claimed, suitable, finely-powdered refractory material is applied and re-applied by means of high-voltage electrical apparatus which imparts charge to the dry powder or dust particles in flight, such that they disperse from each other in a generally uniform distribution before being attracted to the mold workface and landing upon it. The dry particles adhere evenly to the workface in a self-leveling fashion over a wide area. Electrostatic re-application of more powder particles results in the beneficial, uniform self-healing of wear spots. Yet all the powder particles can be removed and replaced continually according to need.

BRIEF DESCRIPTION OF THE DRAWINGS

Other objects, aspects, features and advantages of the present invention will be apparent from the following detailed description of the presently preferred embodiments considered in conjunction with the accompanying drawings, which are presented as illustrative and are not intended to limit the invention. In particular, the specification will proceed in terms of a twin-belt casting machine and usually in terms of the upper carriage of such a casting machine. Corresponding reference numbers are used to indicate like components or elements throughout the various Figures. Large outlined arrows points "downstream" relative to the longitudinal direction (upstream-downstream orientation) of the moving casting mold cavity, and thus it indicates the direction of product flow from entrance into the moving mold cavity to exit therefrom. Normally, the direction of flow of cooling water also is in the "downstream" direction. Plain single-line arrows show the direction of flow of air and powder or dust. Such single-line arrows also show the directions of motion of various components of the casting machine.

DETAILED DESCRIPTION OF THE PREFERRED EMBODIMENTS

This description is written in terms of a twin-belt casting machine as disclosed in U.S. Pat. Nos. 4,588,021 and 3,937,270. In a casting machine employing one or more thin-gauge-belts, the casting belts are moving, endless, thin, flexible, metallic, and water-cooled, the elements of which belts successively enter and leave a moving mold cavity.

Figure 1:
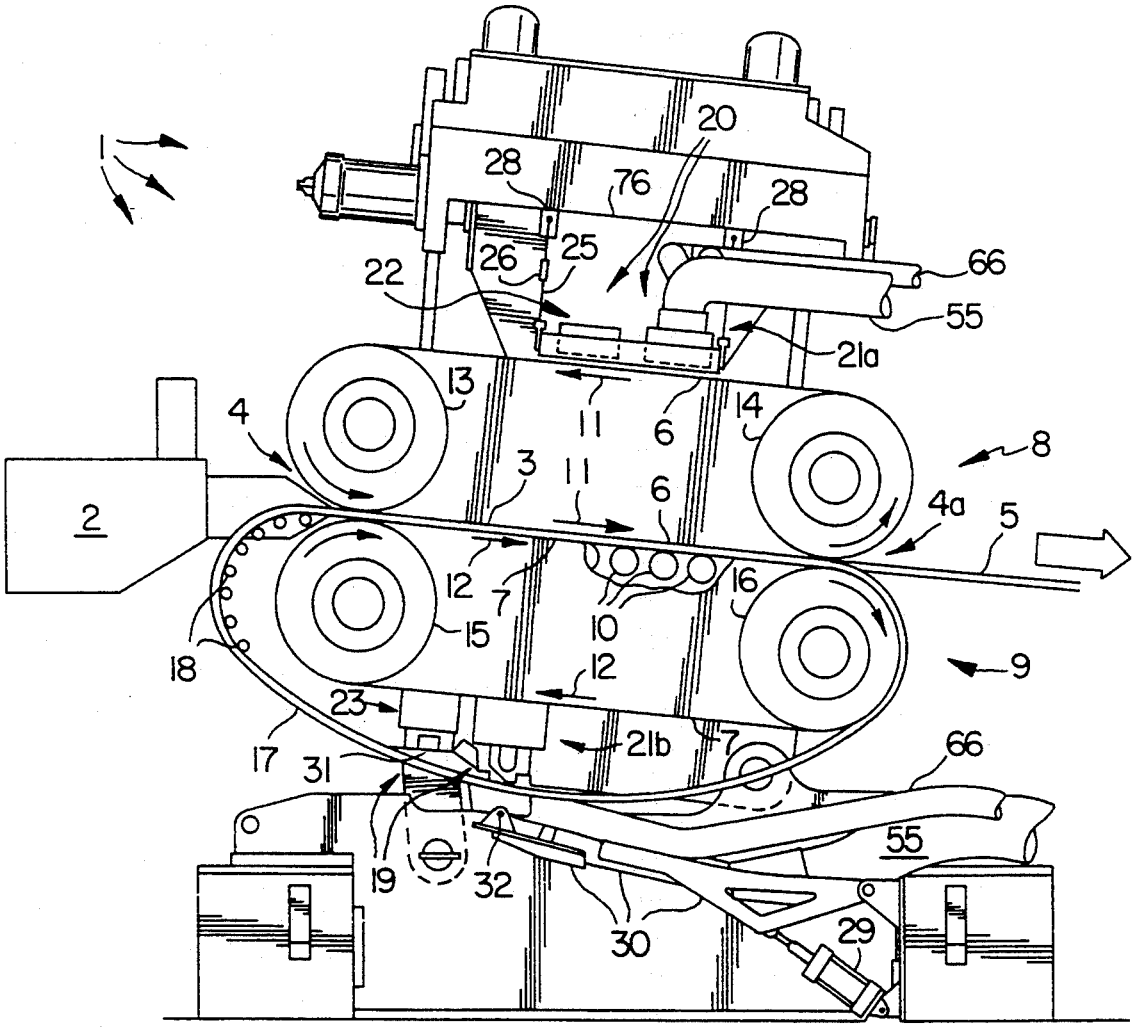
FIG. 1 is an elevation view of a twin-belt casting machine as seen from the outboard side. This machine is shown as an illustrative example of a relatively wide, thin-gauge belt-type continuous metal-casting machine in which the present invention may be employed to advantage.
Figure 2:
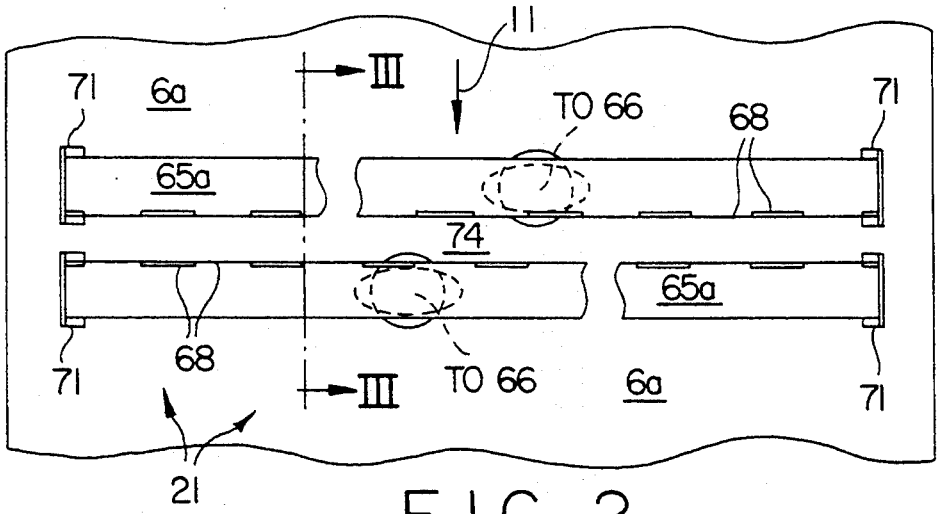
FIG. 2 is a bottom view of a pair of air knife chambers, shown truncated.

In FIG. 1 is shown a belt-type casting machine, illustratively shown as a twin-belt caster 1. Briefly, the machine operates in the following way.

Molten metal is fed from a tundish 2 into entrance 4 of a mold region 3 formed by upper 6 and lower 7 casting belts, revolving in an oval path respectively around the pulley drums 13, 14, and 15, 16. Cast metal product 5 issues from the downstream or discharge end 4*a*. (The plane of product 5 is also denominated spatially as the pass line.) Both casting belts are electrically grounded.

Figure 6A:
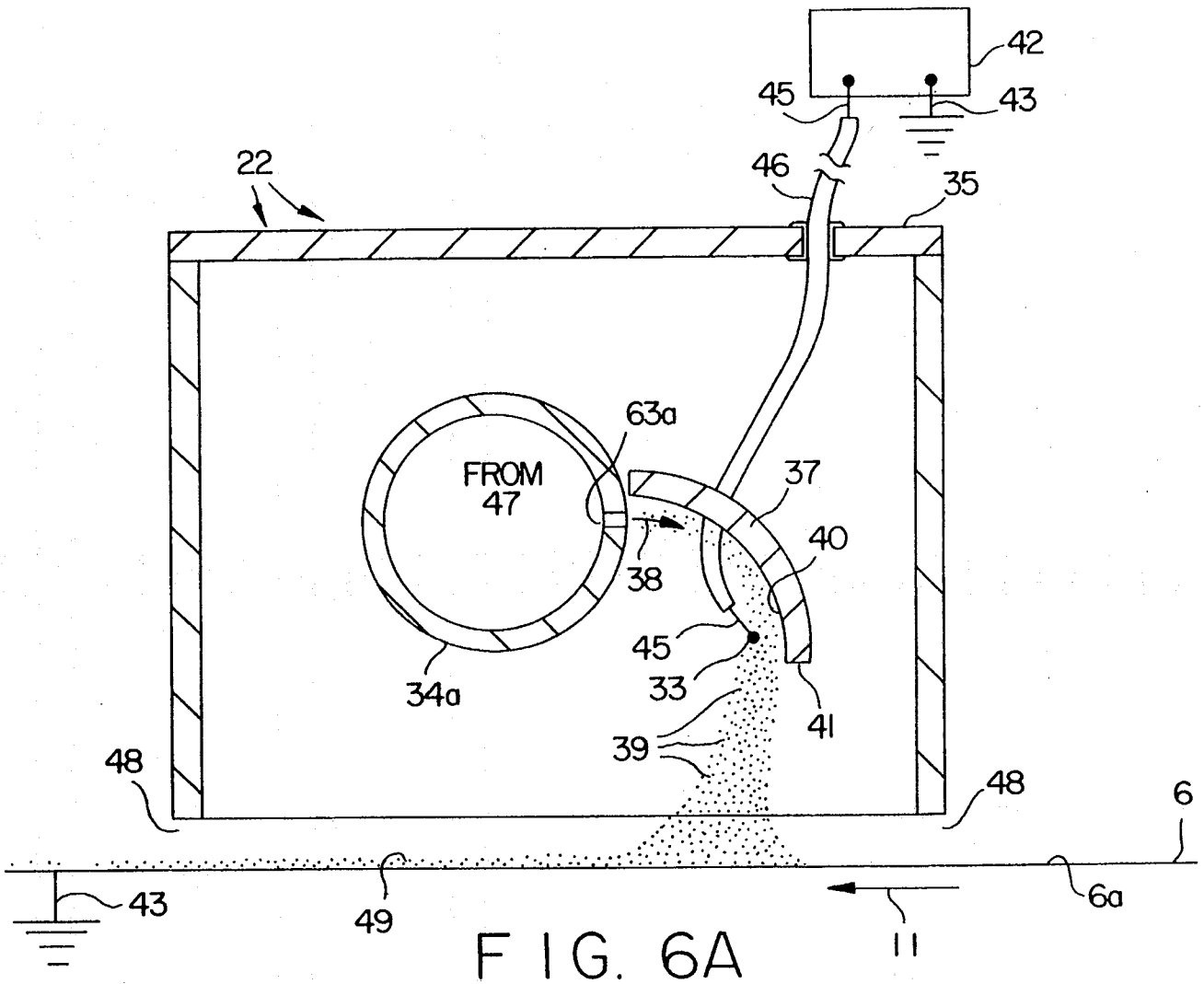
FIG. 6A is an enlarged, cross-sectional elevation view of the powder application box with its single tubular dispenser for applying a coating as shown in FIGS. 5 and 8.
Figure 6B:
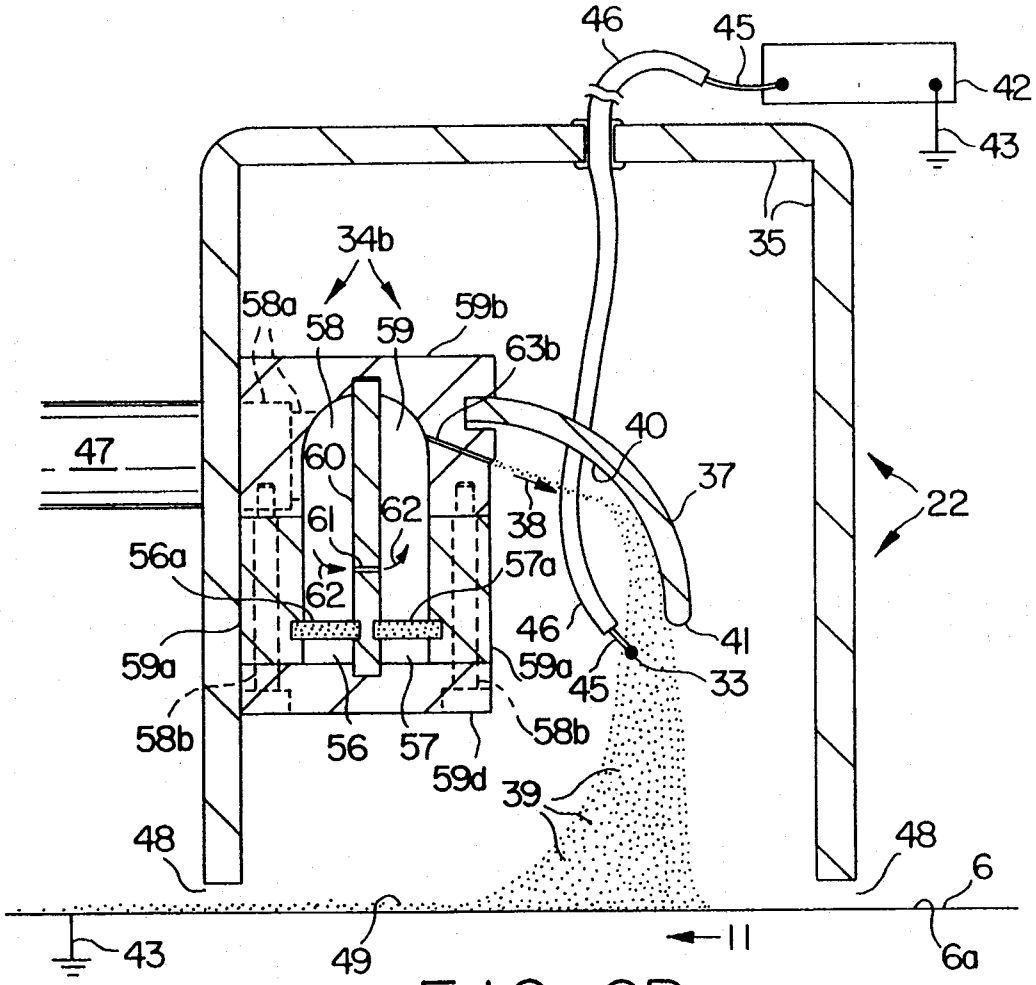
FIG. 6B is the same as FIG. 6A but with the single tubular dispenser replaced with a four-chambered tubular dispenser.
Figure 6C:
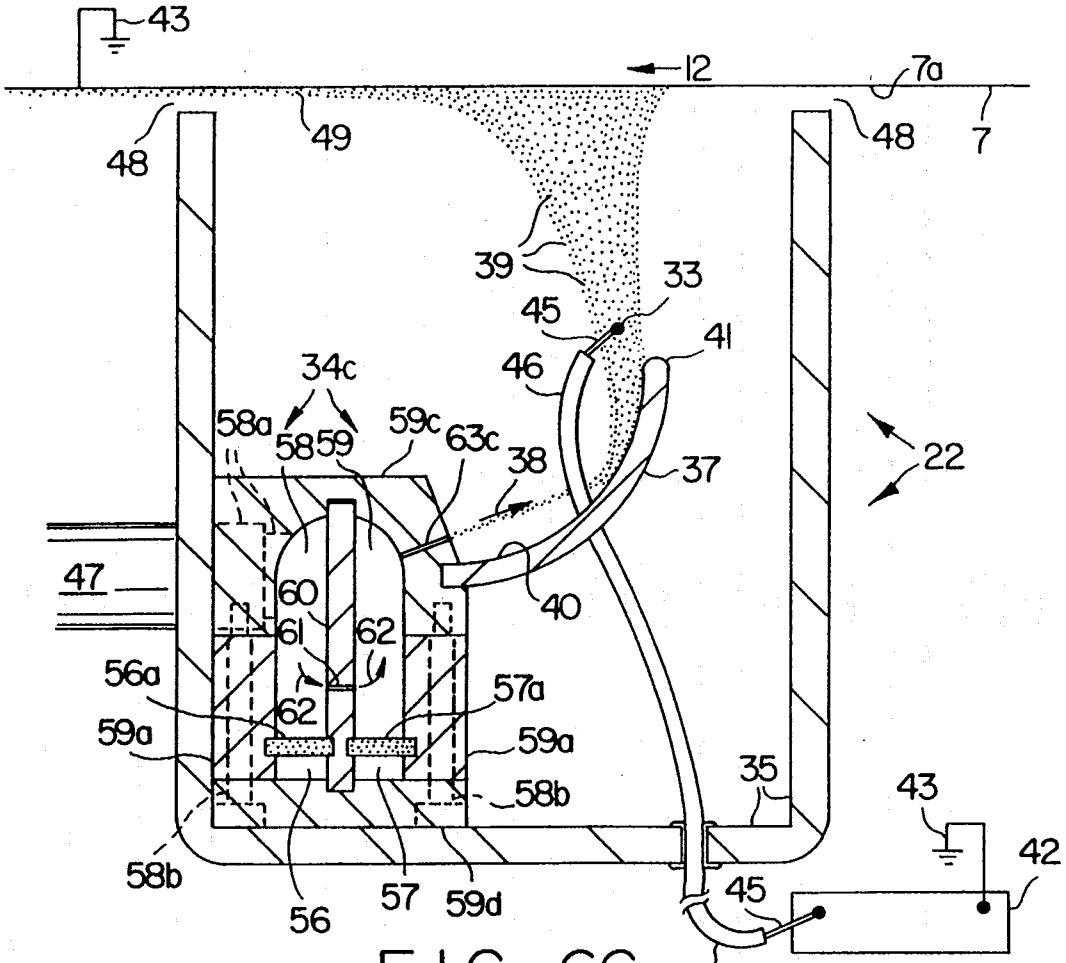
FIG. 6C is like FIG. 6B but with adaptations for applying a coating of powder particles to the lower belt.

In the machine as improved herein, the powder or dust particles are rendered airborne or air-entrained and flow through the hose 47 (FIGS. 7 and 8) to the tubular dispenser 34*a*, 34*b* or 34*c* (FIGS. 6A, 6B, and 6C, respectively).

These air-entrained powder particles are dispensed out of a plurality of apertures in a wall of said tubular dispenser and thence are guided along an inner surface of the deflector 37, thence spreading out in the stream 39 to finally impinge upon the casting belt 6 at an angle of impingement relative to the workface of: the casting belt, said angle of impingement tending toward the perpendicular, that is, being between about 45 degrees and 90 degrees, preferably between about 60 degrees and 90 degrees. Before the stream of air-entrained powder 39 reaches the casting belt, It passes a corona-discharge-producing electrode 33 that extends across the casting width of the casting belt, so that the stream 39 of powder becomes charged thereby and uniformly impinges on the respective casting belt and coats it.

The upper coated belt travels around the pulley drums 13 and 14 on drums 15 and 16 on a lower carriage assembly 9, so that molten metal can an upper carriage assembly 8 and the lower coated belt around the pulley be cast in the mold region 3 between two casting belts so coated.

At the discharge end 4*a*, the coated belts travel around pulley drums 14 and 16, and then the coated belts approach the air-knife equipment 21*a* and 21*b*. Powder particles which are not adhered to the workface of a casting belt are removed by means of the air-knife equipment 21*a* and 21*b*.

After removal of powder particles by the air-knife equipment, the removed powder or dust particles are then soon replaced on the workface of a casting belt by the powder application assembly 22 and 23, with the powder particles spreading out to again uniformly coat each belt. This removal and replacement of powder or dust particles may occur during each revolution of each belt.

Upper and lower casting belts 6 and 7 having workfaces 6*a* and 7*a* respectively and defining between them a moving casting mold cavity 3 are supported and driven by means of pulley drums 13, 14 and 15, 16 on freely-rotatable back-up rollers 10 in both carriages 8 and 9 guide and upper and lower carriage assemblies 8 and 9 respectively. Multiple, support the casting belts 6 and 7 as they move (arrows 11 and 12) along the moving mold cavity 3. For clarity of illustration, only a few of these back-up rollers are shown.

The upper carriage 8 includes two main roll-shaped pulley drums 13 (nip pulley drum) and 14 (tension pulley drum) around which the upper casting belt 6 is revolved as indicated by the single-line arrow 11. Similarly, the lower casting belt revolves as shown by arrow 12 around a lower nip pulley drum 15 and a tension pulley drum 16. Two laterally spaced multiple-block, revolving edge dams 17 (only one is seen) travel typically around rollers 18 to enter the moving casting mold cavity 3. Coolant water is applied to the inside surfaces of the casting belts 6 and 7, and this coolant travels longitudinally along the inside surfaces of the casting belts 6 and 7, as is known in the art.

The reference numbers henceforth usually apply identically to the components of both upper and lower carriages 8 and 9. The description will usually be in terms of the equipment on the upper carriage 8, with the understanding that similar equipment will normally be at an equivalent place in the lower carriage 9. As to the apparatus that is attached to the lower carriage, supporting structures will differ from those shown for the upper carriage, partly because the lower belt 7 sags when slack and it is necessary to keep a slack belt clear of the lower dusting equipment 19 when withdrawing the slackened lower belt to replace it periodically.

Figure 5:
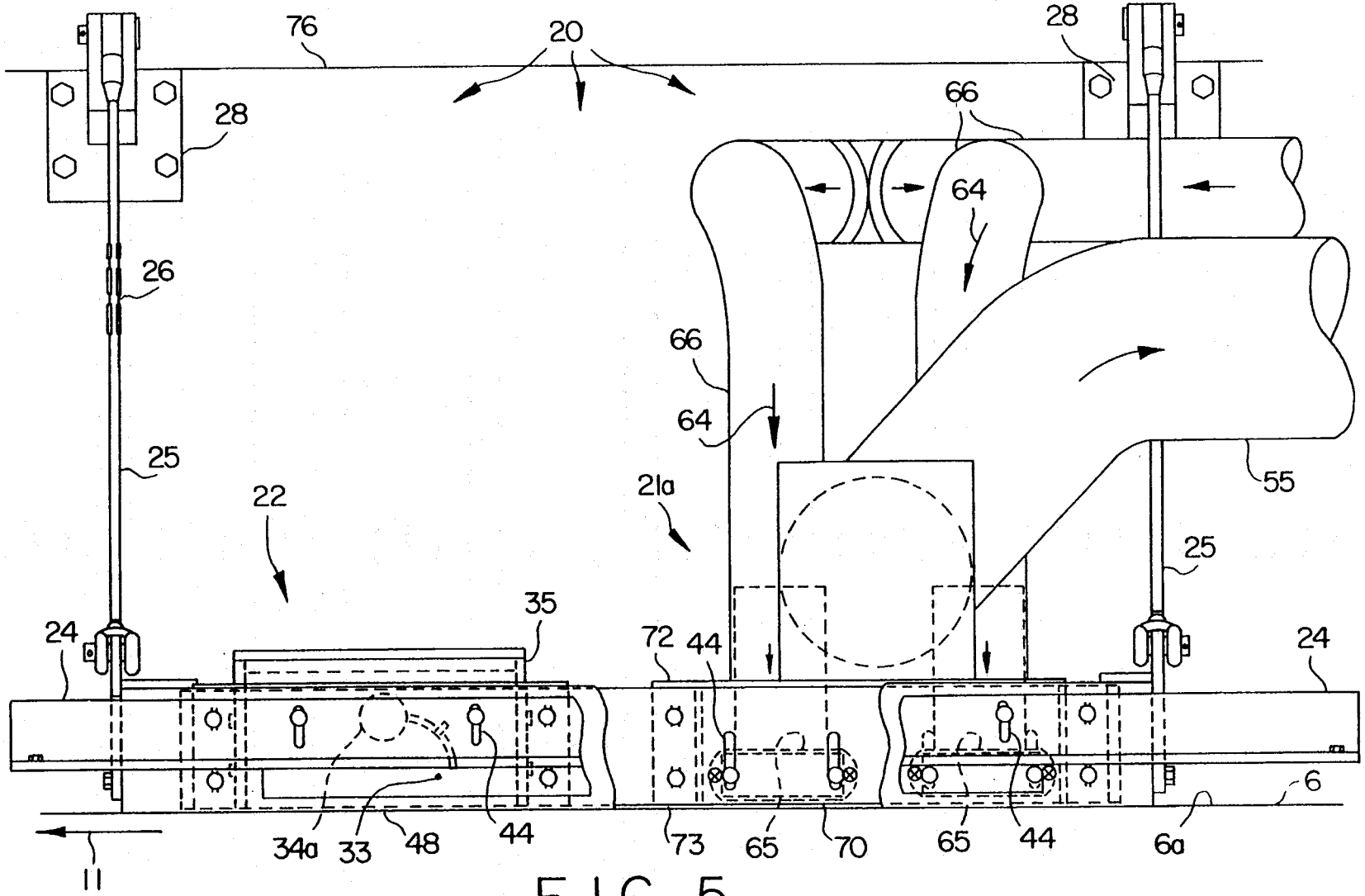
FIG. 5 is an elevation view as seen from the outboard side of an assembly for applying a coating to a workface of a casting belt comprising a powder application assembly, powder removing assembly, and exhaust equipment.
Figure 7:
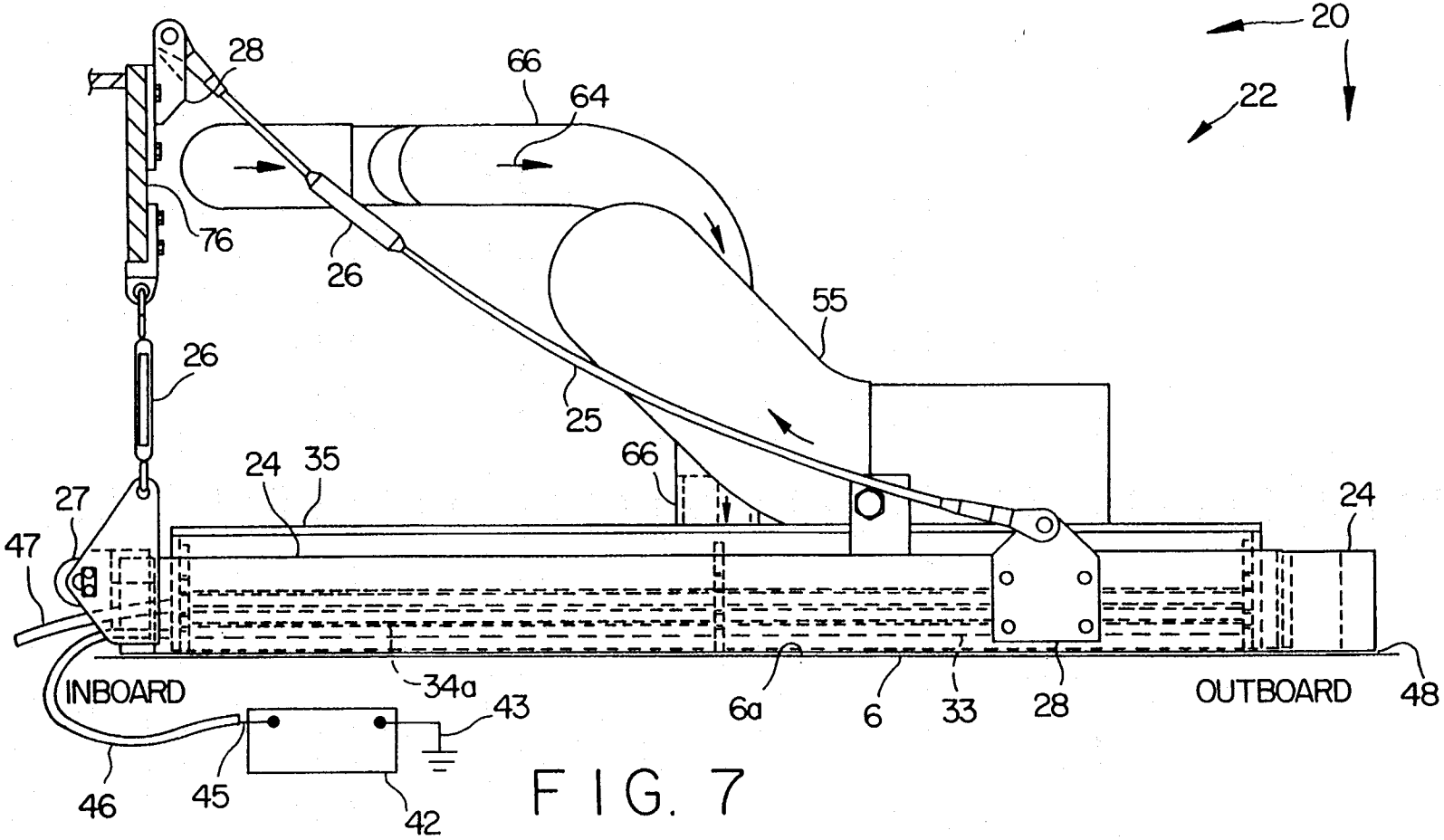
FIG. 7 is an elevation view of the equipment of the assembly shown in FIG. 5, as seen from upstream.
Figure 8:
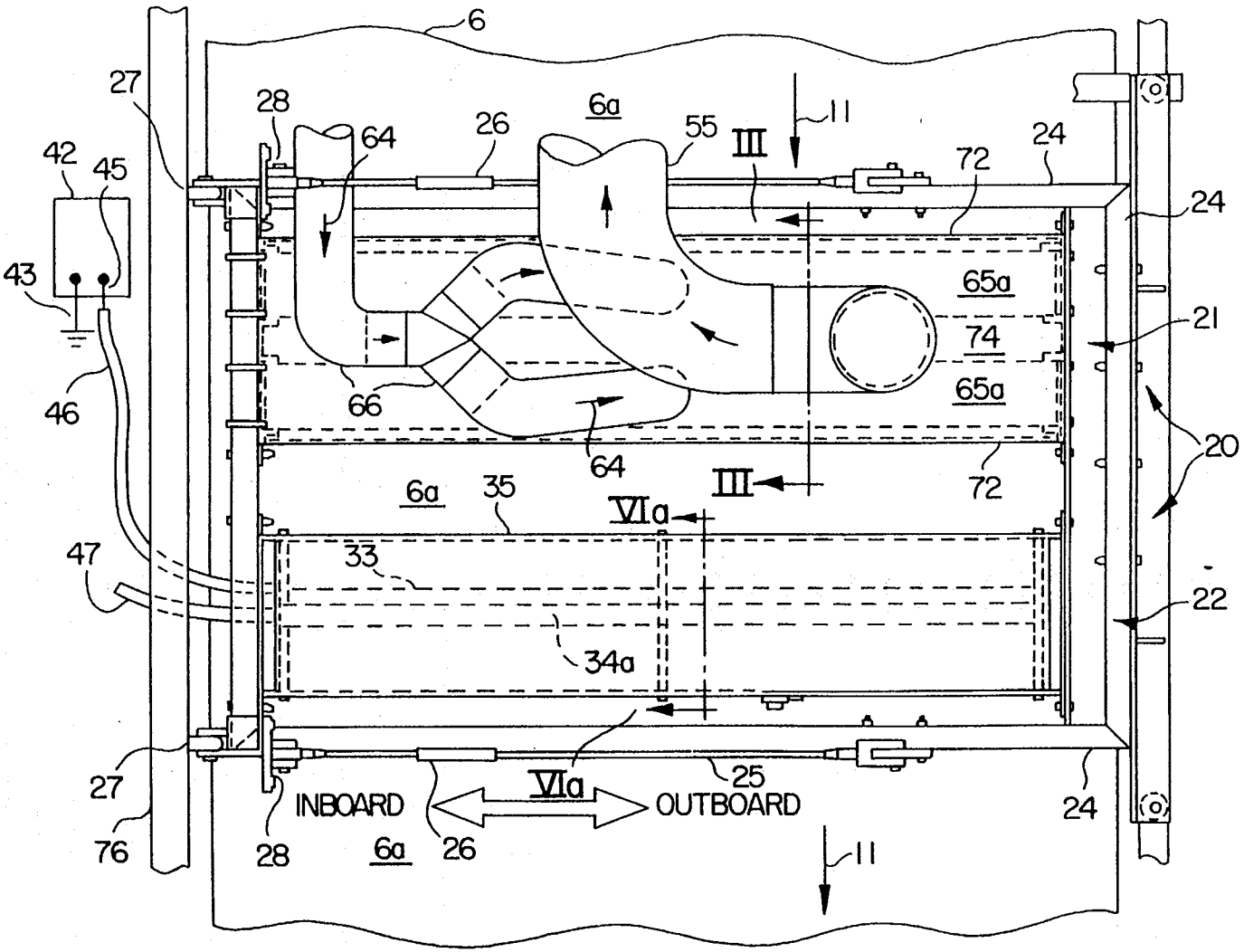
FIG. 8 is a top plan view of the equipment assembly shown in FIGS. 5 and 7.

FIGS. 1, 5, 7 and 8 show an upper-carriage assemblage 20 and a lower carriage assemblage 19, comprising both the powder-coating removal assemblies 21*a* for the upper belt 6 and 21*b* for the lower belt 7, also the coating-application assemblies 22 for the upper belt 6, and 23 for the lower belt 7. Metal framing 24 with associated machine screws and brackets supports said assemblages on the casting machine I near the upper and lower casting belts 6 and 7 (FIGS. 5, 7 and 8). The upper-carriage assemblage 20 is secured to the structure 76 of the upper carriage 8 of the machine 1 by means of cable assemblies 25, turnbuckles 26, brackets 28 and a pair of rollers 27 (FIG. 8). The relative height of the assembly 22 for applying a coating and the powder-removing assemblies 21 is adjustable by means of screw slots 44 (FIG. 5) in the metal framing 24, while the whole assemblage 20 is adjusted down or up, toward or away from a casting belt by means of the turnbuckles 26. The pair of rollers 27 (FIG. 8) accommodate such up or down adjustment.

The corresponding lower assemblage 19 is supported by a cylinder 29 and a lever 30 with a rocker 31 interposed, turning on pivot pin 32.

Each assembly 22 or 23 for applying a coating comprises at least one corona-discharge electrode 33, a tubular powder dispenser 34*a*, 34*b* or 34*c*, a bottomless spray box 35 (topless when installed for the lower belt 7), and a gap 48 along the perimeter of said spray box.

Casting belts that are ready for applying dustings according to the present invention may be either bare or else precoated notably with thermally sprayed refractory materials which we call "basings," according to U.S. Pat. Nos. 4,537,243, 4,487,790 or 4,487,157. These patents are assigned to the same assignee as the present invention. Such thermally applied basings underly the presently disclosed temporary insulative deposit of a dust cushion of dry thermally insulative particles. However, limited success has been attained by using a deposit of a dust cushion according to the present invention without any underlying basing, i.e. on a bare metallic casting belt.

In the preferred embodiment, a transversely oriented corona-discharge-producing electrode—for instance, one or more corona-discharge wires 33 (FIGS. 5, 6A, 6B, 6C and 8)—is placed near to curved or sloping deflector 37 and is spaced from the workface of the casting belt in the path of the powder particles (arrow 38) that come airborne out of a tubular dispenser 34*a* or out of a four-chambered tubular dispenser 34*b* or 34*c*. The wire 33 may conveniently be made of 0.012-inch (0.3 millimeter) diameter wire of austenitic stainless steel. The corona-discharge wire 33 is stretched the length of the curved or sloping deflector 37 (FIGS. 5, 6A, 6B, 6C and 8) in such a way that the oncoming powder (38 and 39) to be adhered to the casting belt passes close by it. The wire 33 lies conveniently near the concavity 40 near its powder-guiding exit edge 41, as shown in FIGS. 6A, 6B and 6C and is spaced about 0.3 of an inch (8 millimeters) away from edge 41. This long corona-discharge wire 33 is charged by a high-voltage power supply 42. Voltage that is direct current, or at least unidirectional in polarity, is applied as indicated via a conductor 45, having a suitable insulation jacket 46. This corona discharge is a key to the charging of the powder particles (see article by Miller). Negative polarity works better than positive polarity for the materials we have found to be of interest. The casting belt 6 or 7 to be dusted is grounded to Earth as indicated at 43 (FIGS. 6A, 6B and 6C) else a powder-repelling charge accumulates on the work, and an operator may get a shock. The corona-discharge electrode 33, normally a wire, may be removed and one (or more) conductive grids or plates placed in its stead as another kind of electrode, but the wire 33 is our preferred mode. Around 30,000 volts (direct current) has been successfully used. According to electrostatic theory, a smaller-diameter wire electrode 33 would enable lower voltages to be used. In any case, the electrode voltages used for electrostatic application of thermally insulative refractory dust or powder to a casting belt are corona-discharge-producing voltages.

A single fluidizing hopper (not shown) and, for each belt, an aspirator pump (not shown) supply powder or dust through a hose line 47. The air or gas that fluidizes, entrains and conveys the powder must be quite dry and quite free from oil. The hose line 47 goes directly to the tubular dispenser 34*a* (FIG. 6A) or directly to the antechamber 58 of the four-chambered tubular dispenser 34*b* (FIG. 6B) or 34*c* (FIG. 6C) which may be made of either conductive or nonconductive material, though it should not be grounded lest extra corona-discharge current unduly load the power supply 42.

The air or gas pressure (relative to atmospheric pressure) within the delivery or exit chamber 59 of tubular dispenser 34*a*, 34*b* or 34*c* should not be greater than about one inch (about 25 millimeters) of water column.

Hose 47 goes into port 58*a* and bears a powder-charged airstream. As to the upper carriage 8, the refractory powder finally emerges downward from assembly 22 to be deposited as a coating 49 on casting belt 6. As to the lower carriage 9, assembly 23 directs the refractory powder upward to cling to casting belt 7.

The following description of the powder coating operation proper is primarily In terms of the apparatus for depositing powder onto the upper belt 6 by means of the assembly 22 of FIGS. 6A and 6B, also in FIGS. 1, 5, 7 and 8 at 22. As shown in FIGS. 6A, 6B (and 6C), the air-entrained stream of powder 38 initially is ejected through the dispensing exit apertures 63*a*, 63*b* (and 63*c*) in a direction which is ultimately convergent toward the workface 6*a* of the respective electrically-grounded metallic casting belt 6. The deflector 37 in FIGS. 6A and 6B advantageously changes the direction of this air-entrained stream 38 downward so that this air-entrained stream of powder 39 passes the electrode 33 while flowing generally directly toward the workface 6*a* of the casting belt 6. In FIG. 6B, the exit holes 63*b* in dispenser top piece 59*b* are directed so as to cooperate in directing the powder against the deflector 37. Consequently, substantially all of the redirected air-entrained powder stream 39 containing the charged powder is descending onto the workface at an angle of at least about 45 degrees relative to the workface. As is shown in FIGS. 6A, 6B (and 6C), substantially all of the charged particles 39 are converging toward the workface at a preferred angular range of at least about 60 degrees relative to the workface as is indicated by the dotted pattern of the freely traveling charged particles 39 approaching more or less directly toward the workface 6*a* of the respective casting belt 6.

Some of the powder or dust that passes through the apparatus will settle out and pile up in the lower portion of tubular dispenser 34*a*, 34*b* or 34*c* under the influence of gravity if not prevented. It is desirable to limit accumulations of powder, since accumulations may emerge untimely, resulting in uneven deposition. Moreover, accumulated stagnant powder may have an undesirable electrical influence on other powder particles.

To meet the powder-settlement problem, we developed the four-chambered tubular dispenser 34*b*, 34*c*, which is our preferred construction. Base 59*d* is connected with side walls 59*a* and top 59*b* (upper carriage) or top 59*c* (lower carriage) by screws 58*b*. Antechamber 58 feeds air-entrained powder into delivery chamber 59, as shown in FIGS. 6B and 6C by the arrow 62. A baffle plate 60 separates the two chambers 58 and 59. The total area of the row or rows of uniformly spaced holes or apertures 61 in baffle 60 is comparable to and substantially equal to the total area of the uniformly spaced exit holes 63 discussed below. These comparable total areas of baffle apertures 61 and exit holes 63 bring about a substantially even distribution of powder regardless of the location of the port or inlet 58*a* from line 47.

Two fluidizing plenums 56 and 57 are employed under chambers 58 and 59 respectively to prevent powders from settling in antechamber 58 and delivery chamber 59. Porous barriers 56*a* and 57*a* permit air under slight pressure within the respective plenums 56 and 57 to refloat any powder that may fall onto the top surfaces of the porous barriers 56*a* and 57*a*. The porous barriers 56*a* and 57*a* are made of polyethylene plastic about 0.19 of an inch (5 millimeters) thick having a pore size nominally of 30 micro-meters.

Gravity enters into the operation of the apparatus. To dust the lower belt 7, changes are required. The four-chambered dispenser tube 34*b* of FIG. 6B cannot be inverted for use under lower belt 7 since the porous membranes 56*a* and 57*a* could then no longer act as levitating floors for settled powder in the inverted position. Yet, the refractory powder or dust stream 38, 39 must now be directed upward against casting belt 7 instead of downward. The four-chambered dispensing tube 34*c* answers the need as is shown in FIG. 6C and assembly 23 (FIG. 1). Here, the curved or sloping deflector 37 is assembled so as to cooperate with the exit holes 63*c* in dispenser top piece 59*c* to direct the powder stream 38 and 39 upward against the workface 7*a* of the casting belt 7.

The tubular dispenser 34*a*, 34*b* or 34*c* emits powder or dust within the confines of a bottomless spray box 35 (FIGS. 5, 6A, 6B, 7 and 8—topless in FIG. 6C for the lower belt 7). The purpose of this box is to prevent the refractory powder from escaping into the surroundings where people would regularly breathe it. This box 35 has a top and four walls. It is about 6 ½ inches (165 mm) in width, i.e., in the direction 11 or 12 and is as long as the "casting width" or "workface width" of a casting belt 6 to be dusted. This box 35 is mounted so that its length extends across the moving casting belt 6 to be dusted. The total width of casting belt 6 is generally at least about eight inches (200 millimeters) wider than the "casting width." The box 35 is made of nonconductive material such as a suitable plastic, or at least the box 35 is lined with a suitable non-conductive material. We have successfully used relatively rigid sheets of commercial polyvinyl chloride plastic material for constructing the box 35. We have found that a box 35 made from such PVC plastic material does not "compete with" the casting belt 6 for attracting the charged powder or dust.

Clearance gaps 48 of about 0.08 to 0.32 inch (about 2 to about 8 millimeters) between the bottom edges of the walls 35 and the moving casting belt 6 or 7 (arrow 11 or 12) being dusted prevent charged air-entrained particles from escaping into the atmosphere. No exhausting of air from this box has proved necessary to protect the surroundings.

Figure 3:
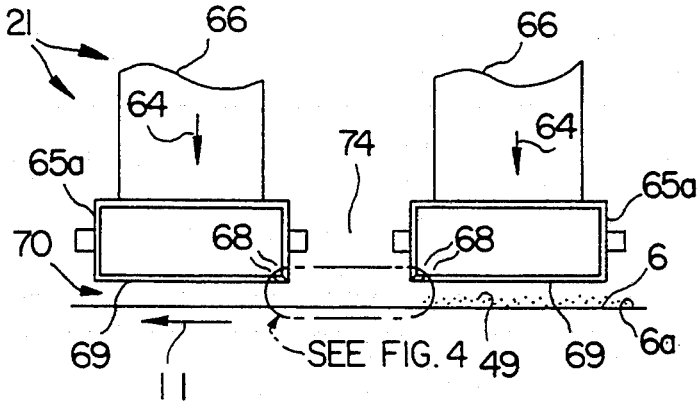
FIG. 3 is a cross-section view of a pair of air knife chambers for the upper carriage, sectioned at III—III in FIGS. 2 and 8. Section lines are omitted for clarity.
Figure 4:
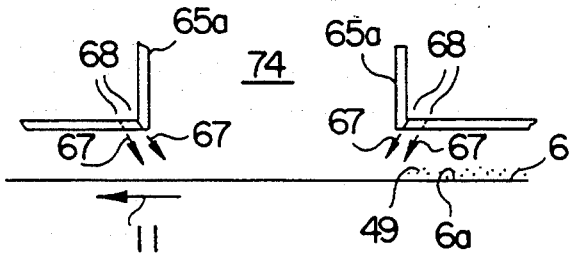
FIG. 4 is an enlarged sectional view of part of FIG. 3 showing the air jets of the air knife chambers. Section lines are omitted for clarity.

Equipment for removing the powder or dust from a belt, i.e., air knives, is generally indicated at 21*a* for the upper carriage 8 and 21*b* for the lower carriage 9. Air 64 (FIGS. 3, 5, 7 and 8) from a single-stage centrifugal blower (not shown) at a pressure, for example, in the range of about 18 to about 26 inches of water column, enters a pair of air knife chambers 65*a*, as shown in FIG. 3 for the upper carriage 8. This air 64 from the blower is fed into these air knife chambers through hoses 66 and creates knife-like jets 67 (FIG. 4), thereby loosening the powder or dust which has previously been applied to the casting belt workfaces 6*a* or 7*a* and which already has been cast upon. A series of inclined jet slots 68 (see also FIG. 3) is cut in the wall 69 of each chamber 65*a* or 65*b* near a belt, alternating in two staggered rows (FIGS. 3 and 4). These slots as shown are about 0.025 of an inch (0.6 mm) wide. They are typically 3 to 4 Inches (75 or 100 mm) long, with the effective part of the slots overlapping each other about 0.08 of an inch (2 millimeters) to ensure that no streaks of undislodged powder are left on the casting belt. The air knife chambers 65 are set at a gap of about 0.25 of an inch (6 millimeters) from the workface of the casting belt per gap 70. Removable end caps 71 on the chambers 65 enable cleaning the interior surfaces and also make possible the leveling of interior burrs during manufacture.

The air knife chambers 65*a* are enclosed in a non-conductive open-bottom plastic suction box 72 (FIGS. 5 and 8), similar in general construction to box 35 for the powder application units 22 and 23. Between a casting belt and this open-bottom suction box 72 is a gap 73 (FIG. 5) of about 0.08 to 0.32 of an inch (about 2 to about 8 millimeters) through which air enters this suction box under an exit vacuum of about 12 inches (about 305 mm) of water column below atmospheric pressure inside the box 72, in order to keep the dislodged dust from entering the atmosphere. As shown in FIG. 4, there is about a 60-degree inclination of the slots 68 relative to the belt, and their relative converging inclinations direct most of the air jets 67 toward a plenum region 74 located within the suction box 72, between the two air knife chambers 65*a*, from whence the dust-laden air is readily extracted through hose 55 which goes to remote filtering and dust-collecting equipment (not shown). In such remote filtering equipment, we use dry, surface-treated filters that are self-cleaning by discharge into a hopper below the filters. Frequent, programmed puffs of back air pressure dislodge the dust or powder so accumulated.

An initial powder or dust distribution 49 (FIGS. 6A, 6B and 6C) is itself strikingly uniform, a fact that is visually observable when the film thickness of the distributed dust is adjusted to be semi-transparent. Unless continually replenished, the dust deposit or cushion becomes thinner and nonuniform as the casting belts turn and are cast upon repetitively. The normal mode of maintenance of the dust deposit 49 is by the electrostatic application of minute additional dustings. Such electrostatic re-depositings of dust particles afford the surprising and very advantageous quality of re-establishing a uniform, immediately useful self-healing of wear spots and scuffs without any interrupting of an ongoing casting operation.

If the resulting dust-cushion deposit 49 becomes contaminated or becomes too thick, it may be removed without difficulty, most conveniently with air jets 67 provided by the air-knife apparatus 21*a* or 21*b* described above. The dust deposit is then immediately renewed as for instance by the distributing station 22 or 23, and the casting of desirable product is continued. With some powders, the air-knife removal is done routinely and is immediately followed by re-application.

However, we have observed that a continuous, very light reapplication of dust (without intentional removal) will automatically and self-adjustably patch over, and effectively repair, even a gross bare spot and will do so within a few revolutions of the casting belt. The patched area may not at once appear uniform, but the effect on the cast product is about as though It were uniform. Advantageously, the all-important requirement of an approximately uniform rate of heat transfer, in or out of the re-dusted previously bare spot, is evidently met by this overall touching-up procedure. This desirable uniformity is in marked contrast to prior-art top deposits or top dressings, where uniformity of heat transfer could not well be regained after a treated area of a casting belt had become worn.

Several finely divided refractory powders or dusts perform acceptably in the present method and apparatus. Powders or dusts should be refractory to the temperatures involved and non-wetting to the molten metal concerned. Among the materials meeting these requirements are zircon, boron nitride, magnesium silicate, and aluminum silicate.

Hard powders can be used but should preferably be of minute particle size. Some refractories are soft enough to ensure that subsequent rolling or drawing will crush them and break them into lesser, harmless minute pieces. Talc, mainly a magnesium silicate, is not hard and it is serviceable. Talc as sold for personal use has a laminated structure. Under our microscopic examination, the larger talc particles were seen microscopically as having a thin delicate three-dimensional structure of warped sheet material, rather like some dried leaves. Another soft material is pyrogenic amorphous silicon dioxide (CAS Registry no. 112945-52-5 or no. 7631-86-9, where CAS stands for Chemical Abstracts Service, Columbus, Ohio, U.S.A.) Although silicon dioxide is generally a hard material, it is rendered effectively soft in this form. Generally, the particles of these two soft materials are translucent or semi-transparent. Identifiable particles of these materials at 90× magnification were seen to be within a size range of about 3 to about 300 micro-meters in their major dimension, with the vast majority of particles by count being below 50 micro-meters in their major dimension. When this material is electrostatically applied, the collective tops of the particles look like cumulus clouds as seen from above the Earth's atmosphere. They present to the molten metal an unevenness that we believe helps to account for their insulativity.

Another suitable electrostatically chargeable refractory powder is boron nitride powder In sizes approaching 1 micro-meter. Yet another is carbon, notably graphite powder reduced in size to between about 5 micro-meters and about 1 micro-meter in size. Compared to oxides, carbon such as graphite or soot is not much of an insulator, either electrical or thermal. However, its low insulativity is useful in the continuous casting of copper wire bar on twin-belt casting machines where high speed casting is desired and where some belt warpage occurs normally and without ill effects, since the copper bar product is not an alloy of copper, and any irregularities of the narrow surface of the bar roll out readily. Graphite is a good parting material; that is, it prevents sticking or welding of the belt to the freezing metal or the hot cast product. Moreover, when graphite is mixed with other, more thermally insulative powder materials, any desired degree of thermal insulativity is attained, thereby enabling the modulating of the rate of heat transfer and of freezing during casting. Soot is similarly useful but is harder to transport in an air stream than is graphite.

Electrostatic application of the above dry materials as dusts is not only convenient; it also leads to results more uniform and serviceable in casting on flexible belts than are obtainable through other methods of application.

THEORETICALLY RELEVANT OBSERVATIONS

In our attempts to design powder distribution apparatus, we learned that electrostatically charged powder particles in free flight away from the electrostatic charging apparatus lose their charge in two seconds or less under any condition known to us. This loss of charge occurs also when nitrogen or argon or carbon dioxide is used as the carrier gas in place of air. High humidity is thought to accelerate the loss of charge but, in our observation, loss of charge occurs even when the humidity is reduced to one part per million of water vapor.

When the electrostatically charged particles strike the belt being coated within less than about a second of free flight, many of the particles stick, being presumably still charged when they land. Once stuck, they remain stuck, resistant to moderate mouth-blowing apparently forever or until they are mechanically detached. This clinging persists on the workfaces of either bare belts or thermally sprayed ceramic-coated belts. However, if the particles are detached from the substrate, by scraping for example, they have lost the ability to reattach themselves to the substrate.

As the refractory powder particles come in for a landing on the casting belt, the inverse-square force becomes large enough to cause a significantly high-speed impact. The high-speed-impacting particle thus presumably would penetrate adsorbed air films and thereby would come into intimate contact with the casting belt such that the van der Waals attractive force would become an effective adherent force.

Regardless of whether any theory inferrable from the above observations is correct or not, the described advantageous successful results are obtained by employing the methods and apparatus of the present invention. Our experiments show that these advantageous results are achieved in casting aluminum alloys and in casting copper in a twin-belt casting machine 1. We believe that the above-described advantageous results are not limited to the casting of any particular metal product.

Although specific presently preferred embodiments of the invention have been disclosed herein in detail, it is to be understood that these examples of the invention have been described for purposes of illustration. This disclosure is not to be construed as limiting the scope of the invention, since the described methods and apparatus may be used on different types of machines or changed in details by those skilled in the art of continuous casting of metals, in order to adapt these methods and apparatus to be useful in particular casting machines or situations, without departing from the scope of the following claims.

We claim:

1. In a method of continuous casting using a belt-type continuous metal-casting machine having a mold region and comprising at least one endless, thin, flexible, water-cooled, metallic casting belt, said belt having a workface bearing a previously applied, fusion-bonded thermally sprayed permanent covering as a basing of refractory material, the elements of said belt successively entering and leaving said mold region, the method including depositing and adhering a substantially uniform distribution of thermally insulative material upon said workface for the purpose of obtaining controlled, uniform heat transfer during successive contacts with molten metal being continuously cast, said method comprising the steps of:

applying over said workface of said casting belt a temporary insulative dusting comprising dry, electrostatically charged, self-adhering, thermally insulative refractory powder particles, followed by the step of:

continuously casting molten metal upon said casting belt having said dusting of dry insulative powder particles thereon, dispensing said dry insulative, electrostatically charged powder particles out of a plurality of apertures spaced across the width of said workface of the casting belt, said insulative powder particles being guided along an inner surface of a deflector, the deflector sloping generally toward said workface of the casting belt, thereby:

directing said dry insulative powder particles to impinge upon said casting belt in a substantially uniform stream across the workface of said casting belt.

2. The method as claimed in claim 1, wherein:

said continuous metal-casting machine comprises two said metallic casting belts.

3. The method as claimed in claim 1, wherein:

said application of said dry, electrostatically charged, self-adhering, thermally insulative refractory powder particles to said workface of the casting belt is continuous, while:

continuing to cast molten metal upon said metallic casting belt without interruption.

4. The method as claimed in claim 1, followed by the further steps of:

removing from said workface of the casting belt said dusting of dry, electrostatically charged, self-adhering, thermally insulative refractory powder particles, followed by the further step of:

reapplying more of said dry, electrostatically charged, self-adhering, thermally insulative refractory particles to said workface of the casting belt, while, continuing to cast molten metal upon said metallic casting belt.

5. The method as claimed in claim 4, wherein:

said removing of said dusting of dry, initially electrostatically charged, self-adhering, thermally insulative refractory powder particles involves a step of applying at least one knife-like thin, wide transversely disposed jet of gas to said dusting.

6. The method as claimed in claim 1, wherein:

the composition of said dry, thermally insulative, self-adhering, refractory powder particles is selected from a group of materials consisting of graphite, pyrogenic amorphous silicon dioxide, and boron nitride.

7. In a method of continuous casting using a belt-type continuous metal-casting machine having a mold region and comprising at least one endless, thin, flexible, water-cooled, metallic casting belt, said belt having a workface bearing a previously applied, fusion-bonded thermally sprayed permanent covering as a basing of refractory material, the elements of said belt successively entering and leaving said mold region, the method including depositing and adhering a substantially uniform distribution of thermally insulative material upon said workface for the purpose of obtaining controlled, uniform heat transfer during successive contacts with molten metal being continuously cast, said method comprising the steps of:

applying over said workface of said casting belt a temporary insulative dusting comprising dry, electrostatically charged, self-adhering, thermally insulative refractory powder particles, followed by the step of:

continuously casting molten metal upon said casting belt having said dusting of dry insulative powder particles thereon, said dry, electrostatically charged, self-adhering, thermally insulative refractory powder particles being charged, attracted to and adhered to the workface of the metallic casting belt through the steps of:

entraining said powder particles in a stream of air, directing said stream of air coming toward the casting belt to an angle of prospective impingement of at least 45 degrees relative to the workface of the metallic casting belt, passing said prospectively impinging stream past an electrode, said electrode extending generally transversely across the workface of said casting belt and being spaced away from said workface across the width of said workface, connecting said electrode to a corona-discharge-productive power source, electrically grounding the casting belt, and revolving the casting belt past said electrode.

8. The method as claimed in claim 7 wherein:

said electrode is positioned among a plurality of electrodes, all connected to a corona-discharge-producing power source.

9. In a method of continuous casting using a belt-type continuous metal-casting machine having a mold region and comprising at least one endless, thin, flexible, water-cooled, metallic casting belt, said belt having a workface bearing a previously applied, fusion-bonded thermally sprayed permanent covering as a basing of refractory material, the elements of said belt successively entering and leaving said mold region, the method including depositing and adhering a substantially uniform distribution of thermally insulative material upon said workface for the purpose of obtaining controlled, uniform heat transfer during successive contacts with molten metal being continuously cast, said method comprising the steps of:

applying over said workface of said casting belt a temporary insulative dusting comprising dry, electrostatically charged, self-adhering, thermally insulative refractory powder particles, followed by the step of:

continuously casting molten metal upon said casting belt having said dusting of dry insulative powder particles thereon, removing from said workface of the casting belt said dusting of dry, electrostatically charged, self-adhering, thermally insulative refractory powder particles, followed by the further step of:

reapplying more of said dry, electrostatically charged, self-adhering, thermally insulative refractory particles to said workface of the casting belt, while, continuing to cast molten metal upon said metallic casting belt without interruption, said removing of said dusting of dry, initially electrostatically charged, self-adhering, thermally insulative refractory powder particles involving a step of applying at least two inclined, thin, wide jets of air to said dusting, aiming said two inclined, thin, wide jets of air in converging relationship toward said dusting, exhausting a region between said two jets of air.

10. In a method of continuous casting using a continuous metal-casting machine comprising a continuously moving mold with a workface the elements of which successively enter and leave a mold region, the method including depositing and adhering a substantially uniform distribution of thermally insulative material upon said workface for the purpose of obtaining controlled, uniform heat transfer during successive contacts with molten metal being continuously cast, said method comprising the steps of:

applying over said workface a temporary insulative dusting comprising dry, electrostatically charged, self-adhering, thermally insulative refractory powder particles, followed by the step of:

continuously casting molten metal upon said workface having said dusting of dry insulative powder particles thereon, said dry insulative powder particles being dispensed out of a plurality of apertures spaced across the width of said workface, said insulative powder particles being guided along an inner surface of a deflector, the deflector sloping generally toward said workface, thereby:

directing said dry insulative powder particles to impinge upon said workface in a substantially uniform stream across said workface.

11. The method as claimed in claim 10, wherein:

said continuous metal-casting machine comprises essentially two moving-mold surfaces having workfaces.

12. The method as claimed in claim 10, wherein:

said application of said dry, electrostatically charged, self-adhering, thermally insulative refractory powder particles to said workface 1s continuous, while:

continuing to cast molten metal upon said workface without interruption.

13. The method as claimed in claim 10, wherein:

the composition of said dry, thermally insulative, self-adhering, refractory powder particles is selected from a group of materials consisting of graphite, pyrogenic amorphous silicon dioxide, and boron nitride.

14. The method as claimed in claim 10, followed by the further steps of:

removing from said workface said dusting of dry, electrostatically charged, self-adhering, thermally insulative refractory powder particles, followed by the further step of:

reapplying more of said dry, electrostatically charged, self-adhering, thermally insulative refractory powder particles to said workface while, and continuing to cast molten metal upon said workface without interruption.

15. The method as claimed in claim 10, followed by the further steps of:

removing from said workface said dusting of dry, electrostatically charged, self-adhering, thermally insulative refractory powder particles, followed by the further step of:

reapplying more of said dry, electrostatically charged, self-adhering, thermally insulative refractory particles to said workface while:

continuing to cast molten metal upon said workface.

16. The method as claimed in claim 15 wherein:

said removing of said dusting of dry, initially electrostatically charged, self-adhering, thermally insulative refractory powder particles involves a step of applying at least one thin, wide, transversely disposed jet of gas to said dusting.

17. In a method of continuous casting using a continuous metal-casting machine comprising a continuously moving mold with a workface the elements of which successively enter and leave a mold region, the method including depositing and adhering a substantially uniform distribution of thermally insulative material upon said workface for the purpose of obtaining controlled, uniform heat transfer during successive contacts with molten metal being continuously cast, said method comprising the steps of:

applying over said workface a temporary insulative dusting comprising dry, electrostatically charged, self-adhering, thermally insulative refractory powder particles, followed by the step of:

continuously casting molten metal upon said workface having said dusting of dry insulative powder particles thereon, said dry, electrostatically charged, self-adhering, thermally insulative refractory powder particles being charged, attracted to and adhered to said workface through the steps of:

entraining said powder particles in a stream of air, directing said stream of air coming toward said workface to an angle of prospective impingement of at least 45 degrees relative to said workface, passing said prospectively impinging stream past an electrode, said electrode extending generally transversely across said workface and being spaced away from said workface across the width of said workface, connecting said electrode to a corona-discharge-productive power source, electrically grounding said workface, and revolving the workface past said electrode.

18. The method as claimed in claim 17, wherein:

said electrode is positioned among a plurality of electrodes, all connected to a corona-discharge-producing power source.

19. In a belt-type continuous metal-casting machine comprising at least one endless, thin, flexible, water-cooled, metallic casting belt having a workface bearing a previously applied, fusion-bonded thermally sprayed permanent covering as a basing of refractory material, the elements of which belt successively enter and leave a mold region, the apparatus for depositing upon and adhering to said mold workface a temporary, substantially uniform dusting of dry, electrostatically charged, self-adhering, thermally insulative, refractory powder particles from a stream of air in which said powder particles are entrained, for the purpose of obtaining controlled, uniform heat transfer during successive contacts with molten metal being continuously cast, said apparatus comprising:

an electrical ground for said workface, said electrode extending generally transversely across said workface and being spaced away from said workface across the width of said workface, a tubular dispenser, a wall of which tube has a plurality of apertures, said apertures being aimed to impinge said powder particles at a low angle against:

a sloping deflector nearby having an inside surface facing generally toward said workface of the metallic casting belt, the shape of said sloping deflector being chosen to result in an angle of impingement of said powder particles of at least 45 degrees relative to said workface, a corona-discharge-productive power supply connected to an electrode positioned near to said sloping inside surface of said deflector.

drive means for continuously moving said workface past said electrode to allow said air-entrained powder particles to be attracted to and to adhere to said workface.

20. Apparatus as claimed in claim 19, wherein:

said electrode is positioned among a plurality of electrodes, all connected to a corona-discharge-producing power source.

21. Apparatus as claimed in claim 19, wherein:

said tubular dispenser is split longitudinally into an antechamber with means for introducing said entrained powder particles thereinto, and a dispensing chamber for emitting such powder particles into the atmosphere, the wall between said two longitudinally extending chambers constituing a baffle which defines within itself a plurality of apertures, said dispensing chamber further comprising a plurality of exit apertures which are in an outside wall of said dispensing chamber.

22. Apparatus as claimed in claim 21, wherein:

said antechamber and said dispensing chamber are each split longitudinally into two separate chambers, one above the other, resulting in a total of four longitudinally extending chambers wherein:

the lower of each of the two chambers has a ceiling of porous material suitable for the passage of fluidizing air from the lower chamber into the upper chamber, whereby the accumulation of settled said dry refractory powder in said antechamber and said dispensing chamber may be prevented.

23. Apparatus as claimed in claim 19, wherein:

said electrode and said means for feeding powder particles are housed in a bottomless spray box, said bottomless spray box having a top wall and side walls, said side walls being spaced away from said workface of said casting belt for providing a clearance gap between each side wall and said workface, said clearance gap between said side walls and said workface and between said side walls and said workface is about 0.08 to about 0.32 of an inch (about 2 to about 8 millimeters).

24. The apparatus as claimed in claim 19, with the addition of:

a pair of air knives separated by an exhaust plenum toward which air escaping from both of said air knives is generally directed, whereby:

said dry refractory powder may be removed from said workface at will.

25. In a continuous metal-casting machine comprising a continuously moving mold with workfaces which successively enter and leave a mold region, the apparatus for depositing upon and adhering to a mold workface a temporary, substantially uniform dusting of dry, thermally insulative, refractory powder particles from a stream of air in which said powder particles are entrained, for the purpose of obtaining controlled, uniform heat transfer during successive contacts with molten metal being continuously cast, said apparatus comprising:

an electrical ground for said workface, a conductive electrode connected to a corona-discharge-productive power source, said electrode extending generally transversely across said workface and being spaced away from said workface across the width of said workface, a tubular dispenser having a plurality of exit apertures in a wall of said tube, said exit apertures being directed toward:

a sloped deflector to direct said stream of air that entrains said powder particles past said electrode and toward said workface to an angle of impingement of at least 45 degrees relative to said workface, drive means for continuously moving said workface past said electrode to allow said air-entrained powder particles to be attracted to and to adhere to said workface.

26. Apparatus as claimed in claim 25, wherein:

said electrode is positioned among a plurality of electrodes, all connected to a corona-discharge-producing power source.

27. Apparatus as claimed in claim 25, wherein:

said tubular dispenser is split longitudinally into an antechamber with means for introducing said entrained powder particles thereinto, and a dispensing chamber for emitting such powder particles into the atmosphere, the wall between said two longitudinally extending chambers constituing a baffle which defines within itself a plurality of apertures; said dispensing chamber further comprising a plurality of exit apertures which are in an outside wall of said dispensing chamber.

28. Apparatus as claimed in claim 27, wherein:

said antechamber and said dispensing chamber are each split longitudinally into two separate chambers, one above the other, resulting in a total of four longitudinally extending chambers wherein:

the lower of each of the two chambers has a ceiling of porous material suitable for the passage of fluidizing air from the lower chamber into the upper chamber, whereby the accumulation of settled said dry refractory powder in said antechamber and said dispensing chamber may be prevented.

29. Apparatus as claimed in claim 25, wherein:

said electrode and said means for feeding powder particles are housed in a bottomless spray box, said bottomless spray box having a top wall and side walls, said side walls being spaced away from said workface for providing a clearance gap between each side wall and said workface, said clearance gap between said side walls and said workface and between said side walls and said workface is about 0.08 to about 0.32 of an inch (about 2 to about 8 millimeters).

said apertures being aimed to impinge said powder particles at a low angle against said sloping inside surface of said deflector, and a corona-discharge-productive power supply connected to an electrode positioned near to said sloping inside surface of said deflector.

30. The apparatus as claimed in claim 25, with the addition of:

a pair of air knives separated by an exhaust plenum toward which air escaping from both of said air knives is generally directed, whereby:

said dry refractory powder may be removed from said workface at will.

31. A revolvable mold wall for use in continuously casting molten metal against said revolvable mold wall, said revolvable mold wall having a workface bearing thereon:

a temporary dry dust cushion comprising:

dry, refractory powder particles, said particles having been carried by an air stream generally in a first direction, with said air stream having been redirected generally to a second direction for carrying said particles generally in said second direction more directly toward the mold wall than said first direction, said particles having been electrostatically charged by corona discharge prior to applying the charged particles to said workface for forming said dry dust cushion on said workface, said particles being non-wetting to molten metal to be cast against said dust cushion on said workface, and said particles being adhered to said workface by their having been electrostatically charged prior to their application to said workface.

32. A mold wall as claimed in claim 31 wherein:

the composition of said dry, thermally insulative, self-adhering refractory powder particles is selected from a group consisting of graphite, pyrogenic amorphous silicon dioxide, and boron nitride.

33. A revolvable mold wall for use in continuously casting molten metal against said mold wall, said revolvable mold wall comprising:

a continuously revolvable, thin, endless, flexible, metallic, water-cooled casting belt;

said casting belt having a workface and bearing upon said workface a fusion-bonded thermally sprayed permanent coating of refractory material as a basing layer, said basing layer bearing thereon a dry dust cushion comprising:

dry, refractory powder particles including particles selected from the group consisting of graphite, pyrogenic amorphous silicon dioxide, and boron nitride, said particles having been carried by an air stream generally in a first direction, with said air stream having been redirected generally to a second direction for carrying said particles generally in said second direction more directly toward said workface than said first direction, said particles having been electrostatically charged by corona discharge prior to applying the charged particles to said workface for forming said dry dust cushion on said basing layer, said particles being non-wetting to molten metal to be cast against said dust cushion on said basing layer, and said particles being adhered to said basing layer by their having been electrostatically charged prior to their application to said workface.

* * * * *